US011884478B2

(12) United States Patent
Kuruvilla et al.

(10) Patent No.: US 11,884,478 B2
(45) Date of Patent: Jan. 30, 2024

(54) EGG CARTON WITH DUAL HANDLES

(71) Applicant: Tekni-Plex, Inc., Wayne, PA (US)

(72) Inventors: Babu Kuruvilla, Duluth, GA (US); Rafael Rivera, Dacula, GA (US); Roger Lichtle, Decatur, IN (US); Mark A. Bergeron, Monroe, GA (US)

(73) Assignee: Tekni-Plex, Inc., Wayne, PA (US)

( * ) Notice: Subject to any disclaimer, the term of this patent is extended or adjusted under 35 U.S.C. 154(b) by 30 days.

(21) Appl. No.: 17/242,350

(22) Filed: Apr. 28, 2021

(65) Prior Publication Data

US 2022/0348399 A1 Nov. 3, 2022

(51) Int. Cl.
*B65D 85/32* (2006.01)
*B65D 25/30* (2006.01)
*B65D 1/36* (2006.01)

(52) U.S. Cl.
CPC ..... *B65D 85/32* (2013.01); *B65D 1/36* (2013.01); *B65D 25/30* (2013.01)

(58) Field of Classification Search
CPC .... B65D 85/32; B65D 85/321; B65D 85/322; B65D 85/324; B65D 85/325; B65D 85/328; B65D 25/30; B65D 25/2888; B65D 25/28; B65D 25/2802; B65D 25/2808; B65D 25/282; B65D 2501/24509; B65D 2501/24515; B65D 2501/24522; B65D 2501/24535; B65D 2501/24541; B65D 2525/28; B65D 5/46072; B65D 21/0212; B65D 25/2805; B65D 25/2882; B65D 25/2885; B65D 5/4208; B65D 5/4608; B65D 71/0003
USPC ..... 206/521.3, 521.1, 521.15, 521.2, 521.8; 220/508, 507, 4.21, 4.22, 4.24, 771
See application file for complete search history.

(56) References Cited

U.S. PATENT DOCUMENTS 3,319,865 A * 5/1967 Livas ..... B65D 85/324 206/521.1
5,590,805 A * 1/1997 Knoss ..... B65D 85/34 220/639

(Continued)

OTHER PUBLICATIONS

Office Action in related Canadian Application No. 3,141,095 dated Feb. 6, 2023.

*Primary Examiner* — Robert Poon
(74) *Attorney, Agent, or Firm* — Polsinelli, P.C.

(57) ABSTRACT

An egg carton having base and lid trays that when disposed in vertical alignment (with the lid tray on top of the base tray) form a closed egg carton. The base and lid trays each include a pair of mating handle components, such that when assembled to form a closed carton provide both enhanced strength and ease of carrying the assembled carton. The handles also facilitate handling of the base and lid trays separately during manufacture, packing and transport, and during and after filling the base with eggs. The new base, lid and carton assembly are particularly useful when adapted for holding more than a dozen eggs, for example when holding 30 or more eggs in a rectilinear array of egg cells (arranged in linear rows and transverse linear columns), such as a 5×6 array of egg cells. The lid may further include a labeling area above a select portion of the base cells, the labeling area comprising a flat panel top wall and a depending sidewall forming an empty interior cavity below the top wall, for insertion of labeling material.

19 Claims, 9 Drawing Sheets

(56) References Cited

U.S. PATENT DOCUMENTS

| | | | | |
|---|---|---|---|---|
| 6,012,583 | A * | 1/2000 | Ramirez | B65D 85/324 206/508 |
| 2005/0189350 | A1* | 9/2005 | Hayes | B65D 43/0204 220/4.24 |
| 2006/0219594 | A1* | 10/2006 | Andrews | B65D 85/32 206/518 |
| 2011/0180446 | A1* | 7/2011 | Kidd | B65D 85/34 206/509 |
| 2015/0327934 | A1* | 11/2015 | Thomas | A61B 50/30 206/438 |

* cited by examiner

EGG CARTON WITH DUAL HANDLES

FIELD OF THE INVENTION

The present invention relates to plastic egg cartons having base and lid trays that together form a closed egg carton with dual carrying handles.

BACKGROUND

Egg cartons are subjected to multiple adverse mechanical forces and environmental conditions during filling, handling and transport between distribution centers, store shelves, and the ultimate consumer's home. They typically encounter automated equipment for filling, packaging, loading, unloading, stacking, restacking and transport. During each of these encounters, the goal is to resist egg breakage by stabilizing and holding the eggs in a protected environment, in a carton that can be manufactured in a cost effective manner.

Thus, many factors are taken into consideration in the design of egg cartons. Egg protection, resistance to stress or force, stackability, transportability, moisture resistance, aesthetic appearance, print surface area, weight, nestability/denestability, adaptability to accommodate various size eggs, and consistent manufacturing are factors which may be considered to varying degrees in the design of an egg carton.

Plastic egg cartons are available with flexible walls between the cell pockets to protect the eggs and prevent them from moving into adjacent cell pockets. However, during handling, such as while loading cases of egg cartons onto a grocery pallet, and then stacking the cases 5 to 6 high on the pallet, the cases/cartons may be thrown onto the pallets and/or bump into each other, causing the eggs to come out of their cell pockets and make contact from a hard side impact blow. Also, when scanning bar codes on lid tops, the eggs can be displaced and/or make contact that damages the eggs.

Thus, there is need for an improved egg carton construction to provide better egg protection while encountering the adverse mechanical forces and environmental changes that typically occur during filing, packaging, transportation and storage. At the same time, there is a need to manufacture such cartons in a cost effective manner and to maintain overall carton dimensions within standard case sizes to avoid a redesign of the existing handling equipment.

SUMMARY OF THE INVENTION

In accordance with one embodiment of the invention a plastic base tray for packaging eggs, the plastic base tray comprising:

a) a thermoformed solid sheet of plastic comprising a top wall and a rectilinear array of recessed base cells arranged in rows and columns depending from the top wall, each base cell having an open top end, a sidewall and a closed bottom wall and being sized and shaped to hold one egg in a generally upright position with the long axis of the egg disposed in a vertical direction transverse to a base plane in which the bottom walls of the base cells reside;

b) the top wall surrounding the array having opposing front and rear edges and opposing left and right side edges; and c) a pair of opposing handle flanges extending from the opposing left and right side edges to form an outermost perimeter of the base tray along with the opposing front and rear edges, each handle flange including a handle recess configured to be grasped by hand for lifting and transporting the base tray with the array of base cells filled with eggs.

In accordance with one embodiment of the invention the handle flanges each define an outermost handle perimeter of the base tray in a width W direction, and the front and rear base tray edges define an outermost tray perimeter in a length L direction, transverse to the W direction, the distances between the respective outermost perimeters in the W and L directions being substantially equal and defining a square base tray footprint.

In accordance with one embodiment of the invention the square base tray footprint is configured to fit within a shipping carton having a matching square interior cavity.

In accordance with one embodiment of the invention the rectilinear base array comprises a 5 by 6 array of cells.

In accordance with one embodiment of the invention each handle flange includes a supporting flange area surrounding the handle recess.

In accordance with one embodiment of the invention the rectilinear base array comprises a 5 by 6 array of cells;

each handle flange includes a supporting flange area surrounding the handle recess, and the flange area has a reduced width from the square base tray footprint so as to define an open area within the square base tray footprint.

In accordance with one embodiment of the invention an assembly comprising the base tray of claim 1 and a mating plastic lid tray, the mating lid tray comprising:

a) a thermoformed solid sheet of plastic comprising a top lid wall and a plurality of lid cells depending from the top lid wall and arranged in a rectilinear array of rows and columns, each lid cell being aligned with one base cell and configured to cover an egg disposed in the aligned base cell;

b) the top lid wall surrounding the lid array having opposing front and rear lid edges and opposing left and right side lid edges; and fc a pair of opposing lid handle flanges extending from the opposing left and right side lid edges to form an outermost perimeter of the lid tray along with the opposing front and rear lid edges, each lid handle flange including a lid handle recess aligned with an associated handle recess of the base tray and configured to be grasped by hand for lifting and transporting the assembly of the lid tray and the base tray with the array of base cells filled with eggs.

In accordance with one embodiment of the invention the base tray and lid tray have mating components for maintaining vertical alignment of the each lid cell and associated base cell.

In accordance with one embodiment of the invention the handle flanges of the lid tray each define an outermost lid handle perimeter of the lid tray in a width W direction, and the front and rear lid tray edges define an outermost lid tray perimeter in a length L direction, transverse to the W direction, the distances between the respective outermost lid perimeters in the W and L directions being substantially equal and defining a square lid tray footprint.

In accordance with one embodiment of the invention the square base tray and lid tray footprints are configured to fit within a shipping carton having a matching square interior cavity.

In accordance with one embodiment of the invention the rectilinear base array and the rectilinear lid array each comprise an aligned 5 by 6 array of cells.

In accordance with one embodiment of the invention the rectilinear base array comprises a 5 by 6 array of cells;

each base handle flange and lid handle flange includes a supporting flange area surrounding the handle recess, and the flange area has a reduced width from the square base tray footprint and so as to define an open area within the square base tray footprint.

In accordance with one embodiment of the invention the base and lid trays have mating support posts disposed between the cells of the base and lid arrays for maintaining alignment of the mating base and lid cells.

In accordance with one embodiment of the invention the lid tray includes a flat top wall label panel area without lid cells.

In accordance with one embodiment of the invention the label panel area is disposed between rows of lid cells and between the front and rear lid edges.

In accordance with one embodiment of the invention the base tray includes support posts for supporting the label panel area.

In accordance with one embodiment of the invention a stack of assembled base and lid trays according to claim 7, comprising a plurality of assembled base and lid trays aligned in a stack, with the aligned cells of the lid and base arrays aligned with a vertical stack axis.

In accordance with one embodiment of the invention a stack of assembled base and lid trays according to claim 9, comprising a plurality of assembled base and lid trays aligned in a stack, with the aligned cells of the lid and base arrays aligned with a vertical stack axis.

In accordance with one embodiment of the invention a carton containing the stack of assembled base and lid trays according to claim 18, wherein:

the square base tray and lid tray footprints are configured to fit within a matching square interior cavity of the carton.

In accordance with one embodiment of the invention the rectilinear base array comprises a 5 by 6 array of base cells.

In accordance with one embodiment of the invention the rectilinear base array and the rectilinear lid array each comprise an aligned 5 by 6 array of base and lid cells.

In accordance with one embodiment of the invention the rectilinear base array comprises a 5 by 6 array of base cells and the lid array comprises a 3 by 6 array of lid cells and a label panel area without lid cells.

In accordance with one embodiment of the invention the base tray and lid tray are thermoformed from the same solid sheet of plastic and include a hinge connecting portion between the base tray and lid tray.

In accordance with one embodiment of the invention the hinge portion extends between the base and lid handle flanges on the left of right sides of the aligned base and lid trays.

BRIEF DESCRIPTION OF THE DRAWINGS

FIGS. 1-3 illustrate one embodiment of an assembled base tray and lid tray for packaging eggs in aligned cells of the lid and base trays, wherein: FIG. 1 is an exterior top perspective view of the assembled base and lid trays forming the closed egg carton, as viewed from the front and right side of the carton, showing the flat top wall label panel area on the lid and the dual handles extending from the opposing right and left sides, respectively; FIG. 2 is a front plan view of the closed egg carton of FIG. 1; and FIG. 3 is a right side plan view of the closed egg carton of FIG. 1;

FIGS. 4-6 illustrate further details of the base tray of FIGS. 1-3, wherein: FIG. 4 is an exterior bottom plan view of the base tray; FIG. 5 is a front plan view of the base tray (aligned as shown in FIG. 2); FIG. 6 is a right side plan view of the base tray (aligned as shown in FIG. 3);

FIGS. 7-9 illustrate further details of the lid tray of FIGS. 1-3, wherein: FIG. 7 is an exterior top plan view of the lid tray; FIG. 8 is a front plan view of the lid tray (aligned as shown in FIG. 2); and FIG. 9 is a right side plan view of the lid tray (aligned as shown in FIG. 3);

FIGS. 10-11 illustrate the base tray and lid tray of FIGS. 1-3 in an unassembled state, wherein: FIG. 10 is a top perspective view of the interior of the base tray, and FIG. 11 is a bottom perspective view of the interior of the lid tray;

FIG. 12 is an exterior top perspective view of an aligned vertical stack of two closed egg cartons; FIG. 13 is a front cross sectional view of an aligned vertical of four closed egg cartons disposed in a packing case having an interior cavity that matches the footprints of the lid and base trays of the closed cartons; and FIG. 13A is a top plan view of a stack of closed cartons in a packing case.

FIG. 15 shows the subsequent assembled base tray and lid tray filled with eggs, showing the posts of the base tray supporting the interior cavity of the lid tray below the flat panel label area (without lid cells).

FIG. 16 is a top perspective view of the lid and base tray with hinge connection in a closed position showing the hinge connection between the aligned right side handle flanges of the lid and base trays; FIG. 17 is a top plan view of the open carton showing the hinge connection in the open position between the lid and base trays; FIG. 18 is right side view showing the hinge connection and the mating base tray and lid tray edges seated together in the close carton position; and FIG. 19 is a vertical cross sectional view of the closed carton showing a row of 5 eggs, each egg disposed in a vertical position between an aligned base cell and lid cell (in 3 of the columns) and disposed in a vertical position between a base cell and the lid panel area (in 2 of the 5 columns), with the hinge connection in the closed position on the right side of the carton.

DETAILED DESCRIPTION

Figure 1:
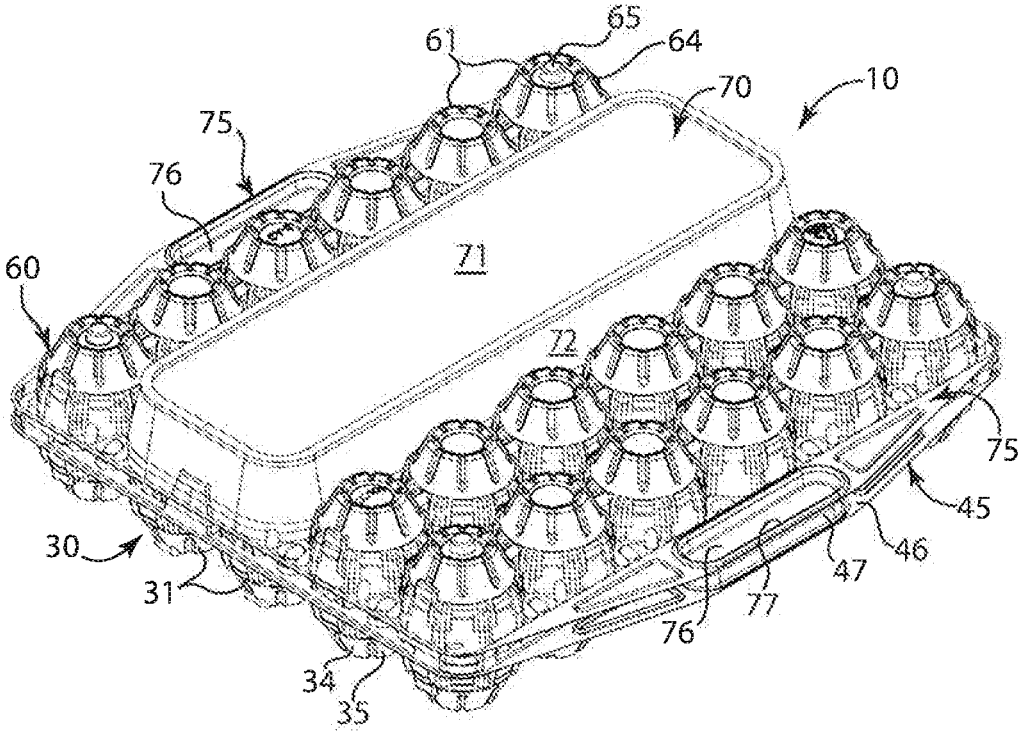

Separate Lid and Base Trays (FIGS. 1-14)

In one embodiment, the present invention is directed to a two piece egg carton 10, comprising separate base and lid trays 30, 60 that when assembled in a stacked vertical alignment (with the lid tray on top of the base tray), form a closed egg carton. The base and lid trays each include a pair of mating handle components 45, 75, such that when assembled to form a closed carton provide both enhanced strength and ease of carrying the assembled carton. The handles also facilitate handling of the base and lid trays separately during manufacture, packing and transport, and during and after filling the base with eggs. The new base, lid and carton assembly are particularly useful when adapted for holding more than a dozen eggs, for example when holding 30 or more eggs in a rectilinear array of egg cells (arranged in linear rows and transverse linear columns), such as a 5×6 array of egg cells. The lid may further include a labeling area 70 above a select portion of the base cells, the labeling area comprising a flat panel top wall 71 and a depending sidewall 72 forming an empty interior cavity 73 below the top wall, the cavity being without lid cells. Mating lid and base posts 32, 62 are provided for supporting the lid over the base, with extended height base posts 33 supporting the flat panel top wall. These and other features of the present invention will be apparent from the following description of various embodiments.

Figure 2:
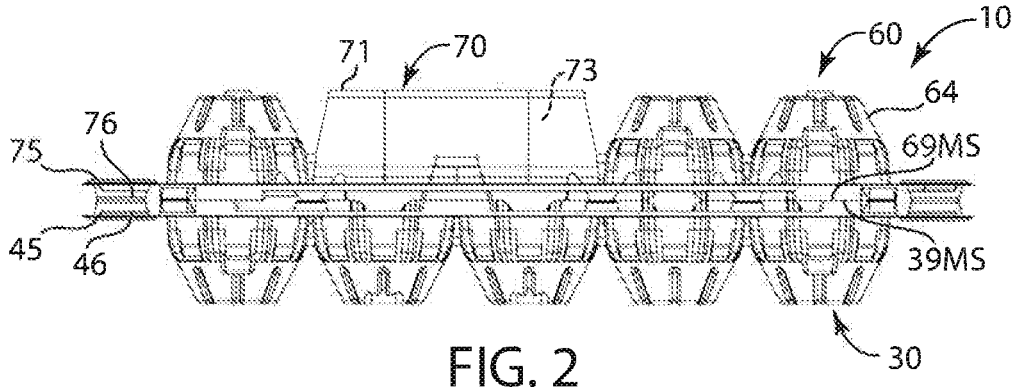
Figure 3:
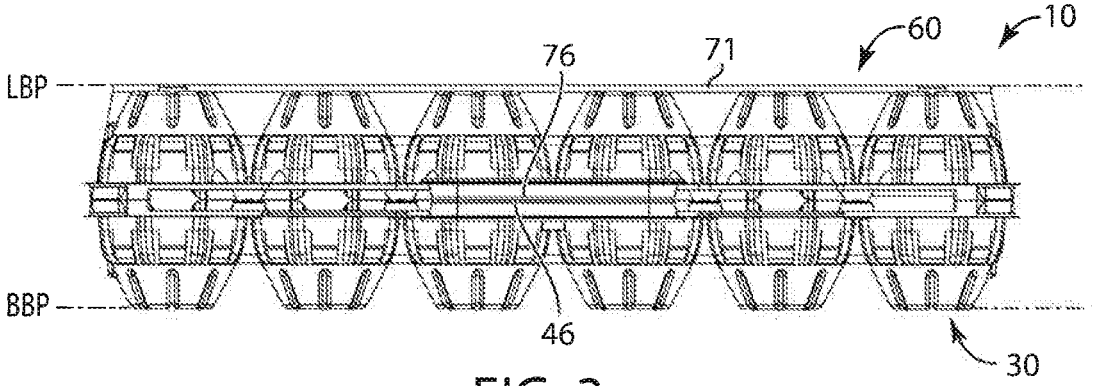

As shown in the accompanying figures, FIGS. 1-14 illustrate one embodiment of the present invention, wherein:

FIGS. 1-3 illustrate exterior views of a base tray 30 and lid tray 60 assembled to form a closed carton 10 according to one embodiment, showing the dual mating handles 45, 75 on opposing side edges of the carton. Each of the base tray and lid tray have a generally rectilinear perimeter 30P, 60P in horizontal cross section, that when assembled form a generally rectilinear carton perimeter 10P in horizontal cross section, with mating opposing front and rear base/lid/carton edges 30F/60F/10F and 30R/60R/10R, and mating opposing right and left side base/lid/carton edges 30RS/60RS/10RS and 30LS/60LS/10LS.

Figure 4:
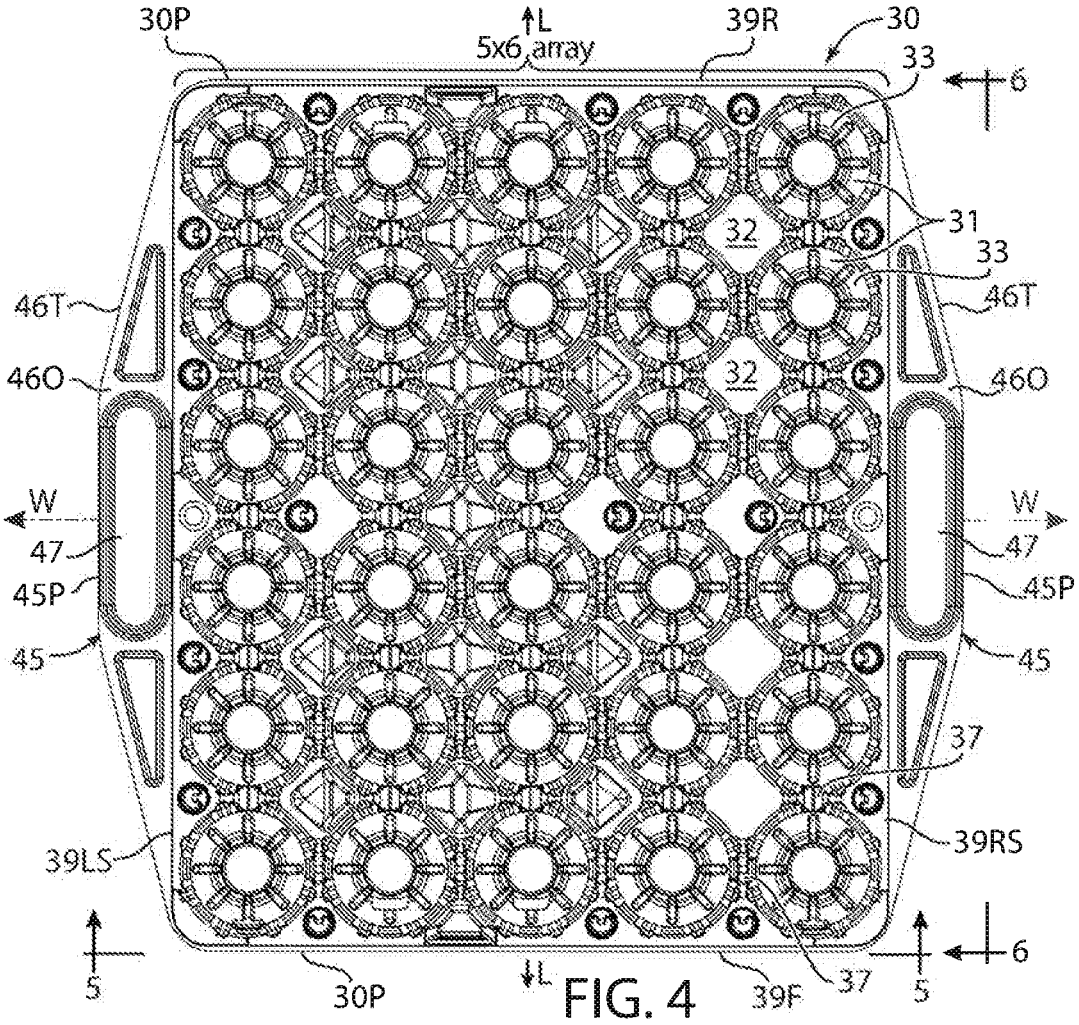
Figure 5:
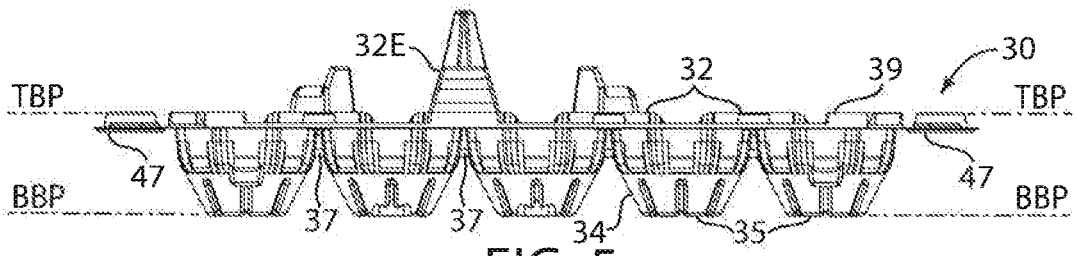
Figure 6:
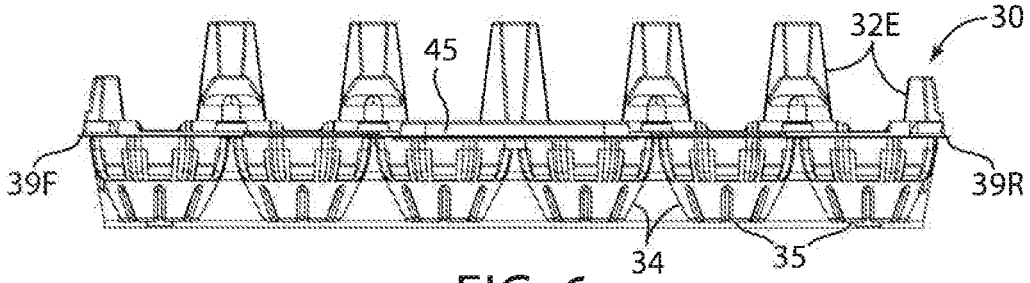

FIGS. 4-6 illustrate various views of the base tray (of FIGS. 1-3) alone.

Figure 7:
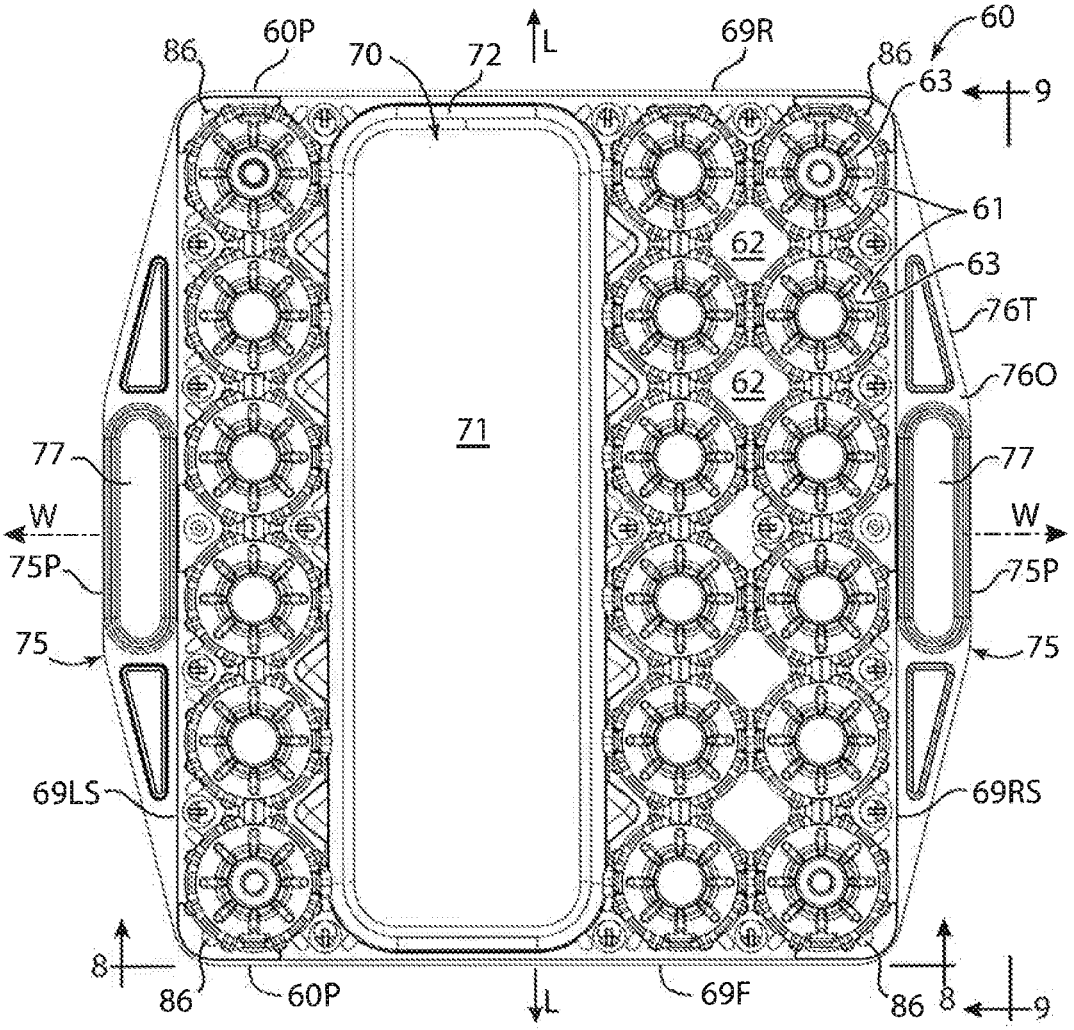
Figure 8:
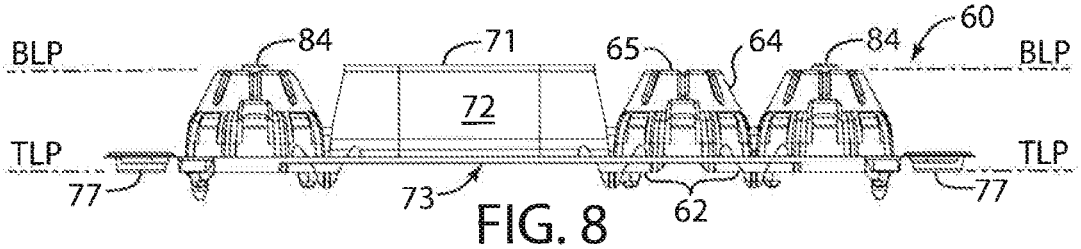
Figure 9:
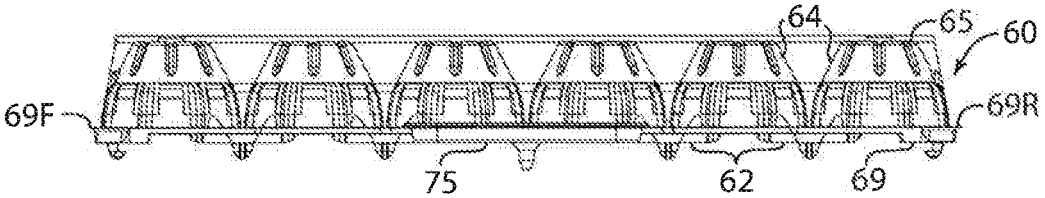

FIGS. 7-9 illustrate various views of the lid tray (of FIGS. 1-3) alone.

Figure 10:
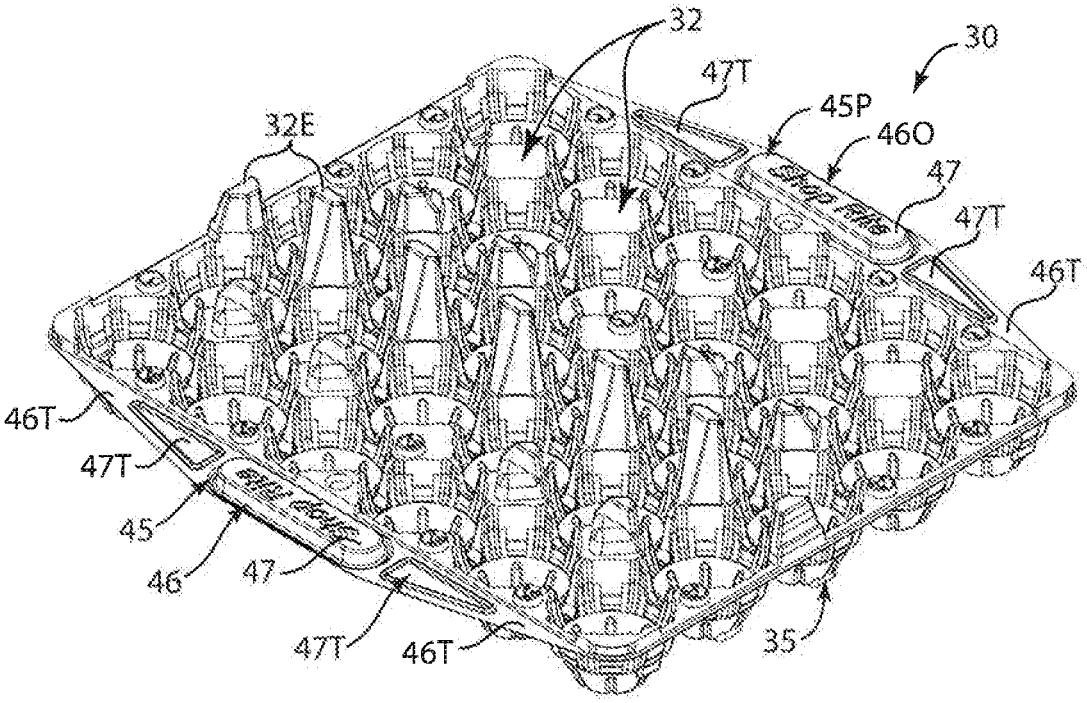
Figure 11:
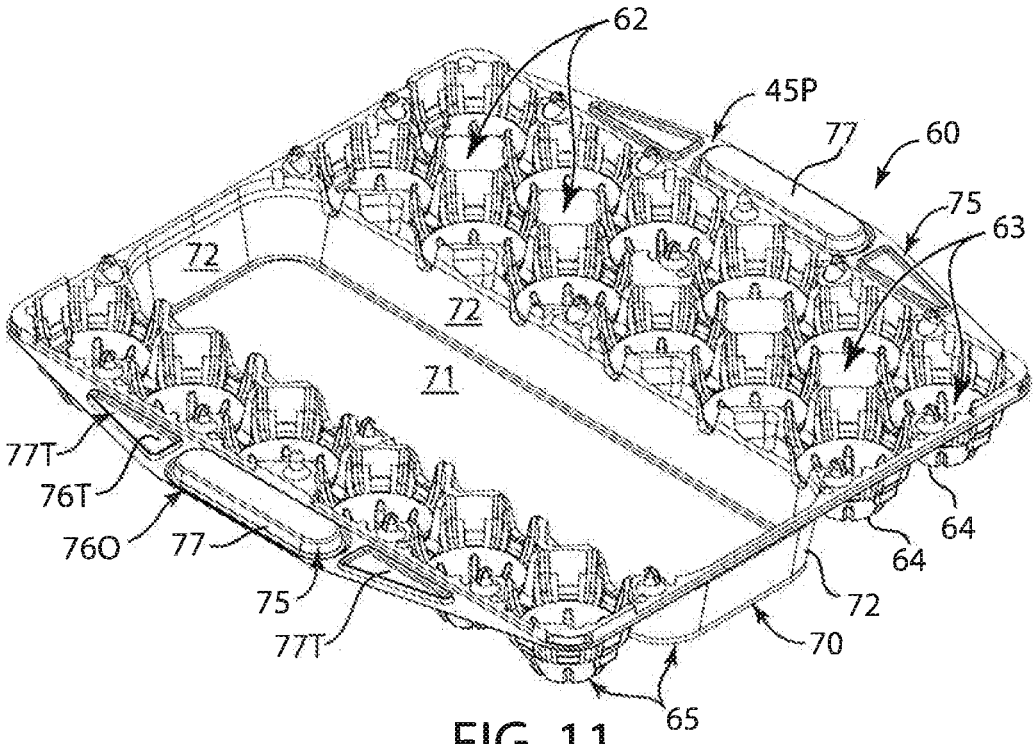

FIGS. 10-11 illustrate interior views of the base and lid trays, respectively.

Figure 12:
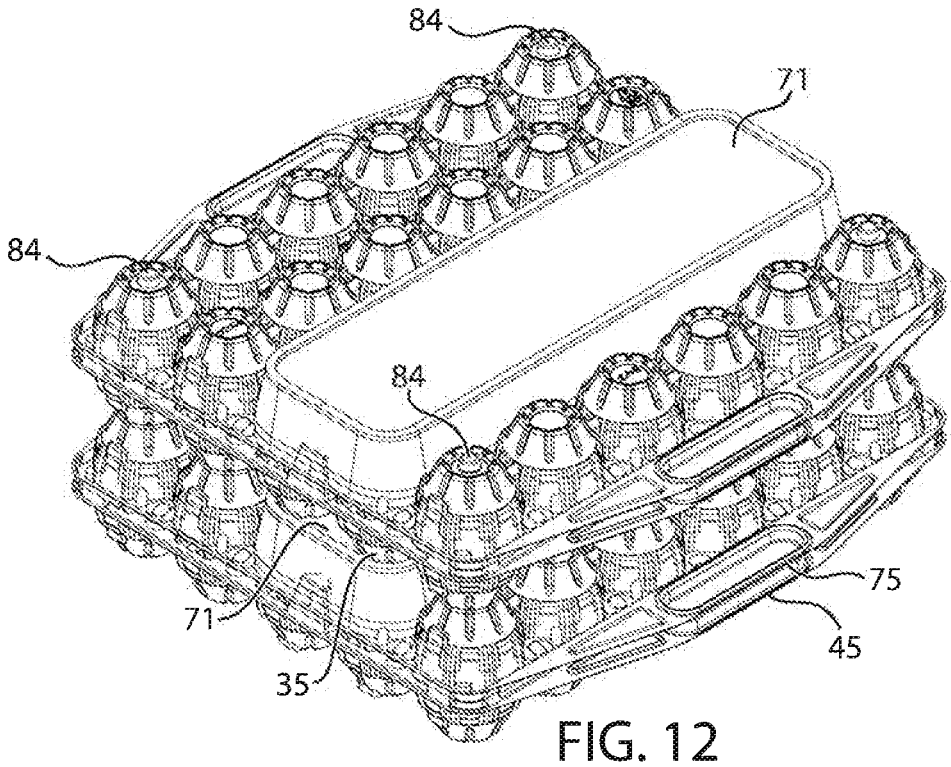
FIGS. 12-13 and 13A illustrate a vertical stack of closed egg cartons, and a vertical stack of closed egg cartons disposed in a packing case (e.g., shipping container)
Figure 13:
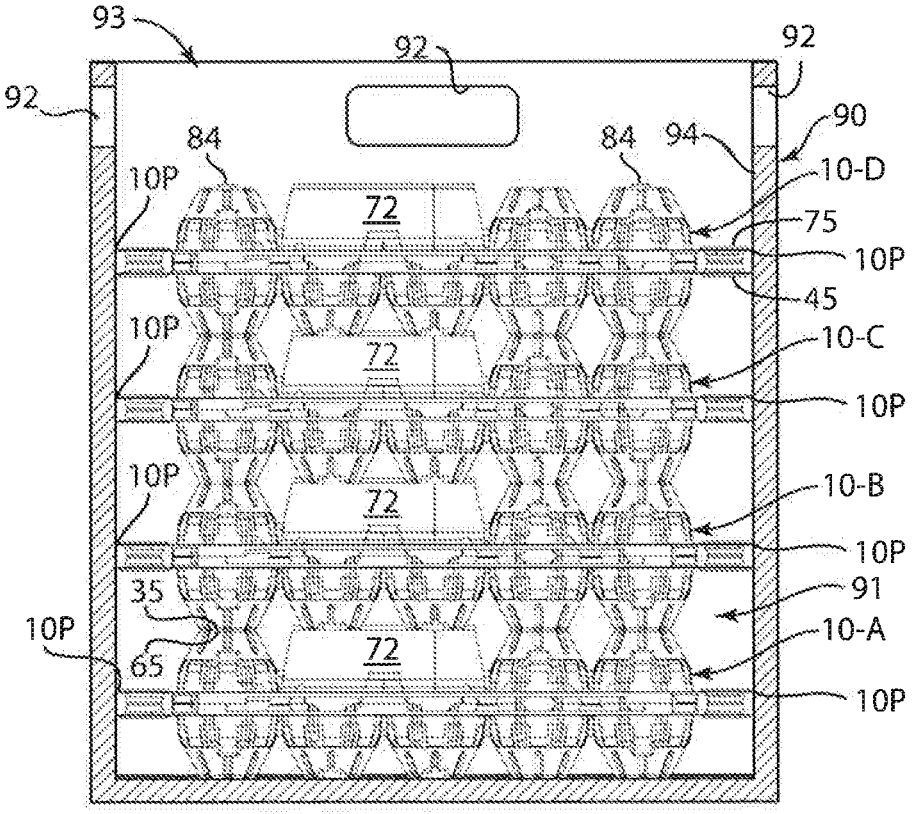
Figure 13A:
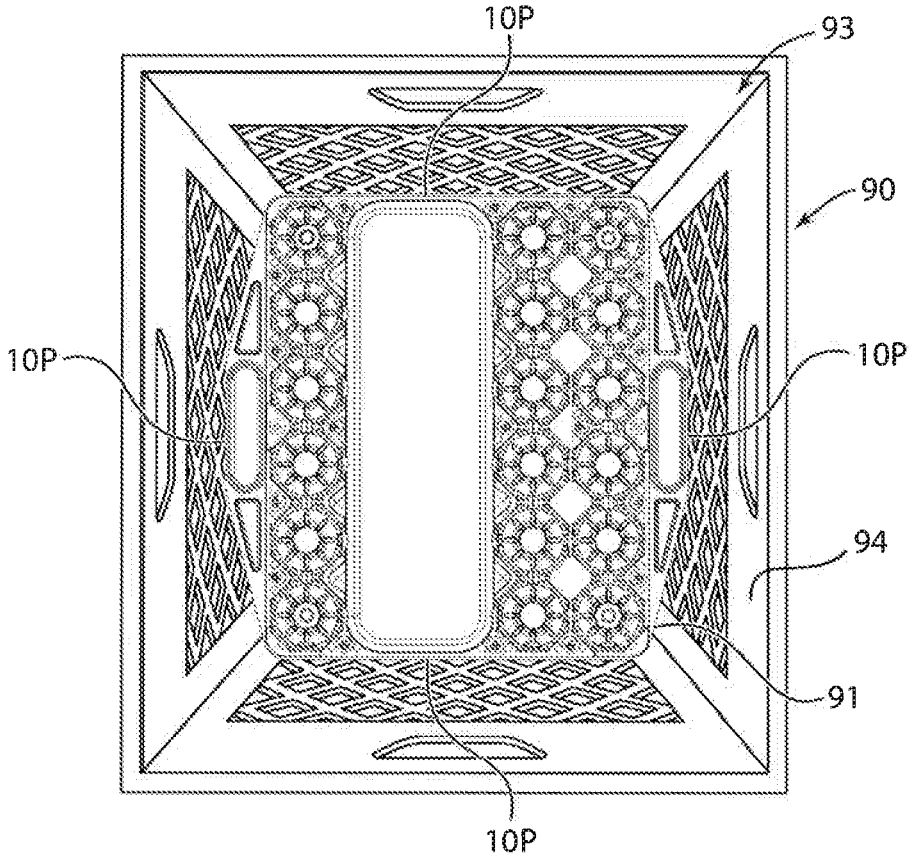

FIGS. 12-13 illustrate two arrangements of stacked trays; FIG. 12 shows a pair of vertically stacked closed cartons; FIG. 13 shows four vertically stacked cartons disposed in a packing case; and FIG. 13A is a top view of a stack of closed cartons in a packing case.

Figure 14:
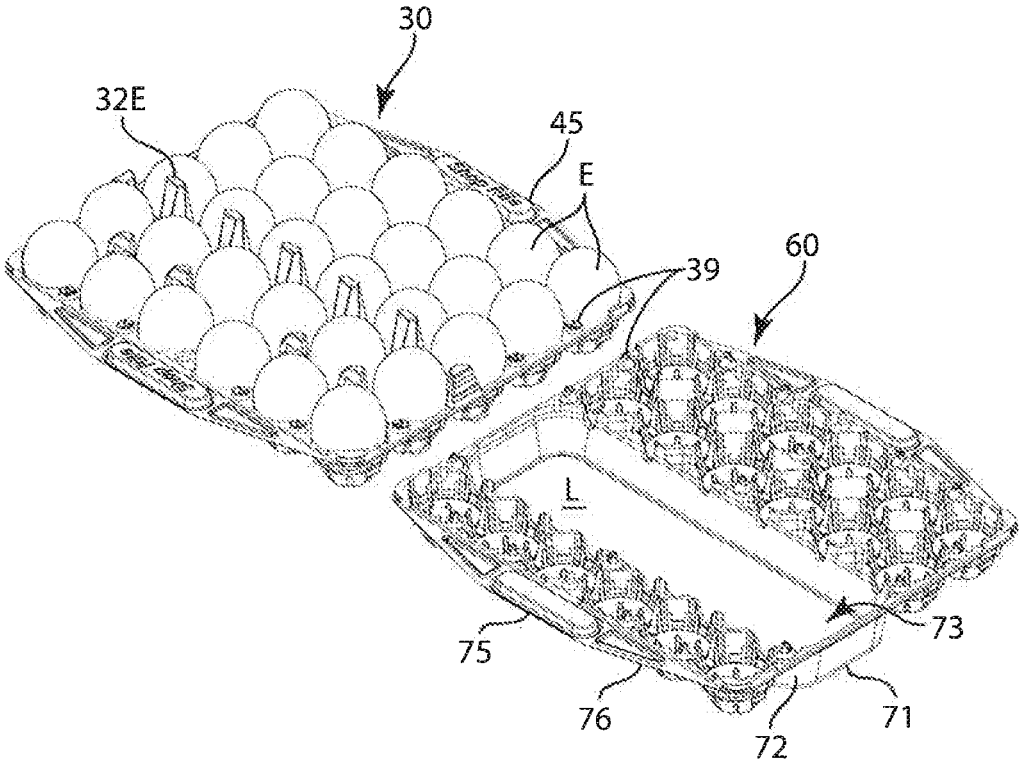
FIGS. 14-15 illustrate the base tray and lid tray of FIGS. 1-3 when filled with eggs, wherein, FIG. 14 includes perspective views of the unassembled lid and base trays, with the cells of the base tray filled with eggs.
Figure 15:
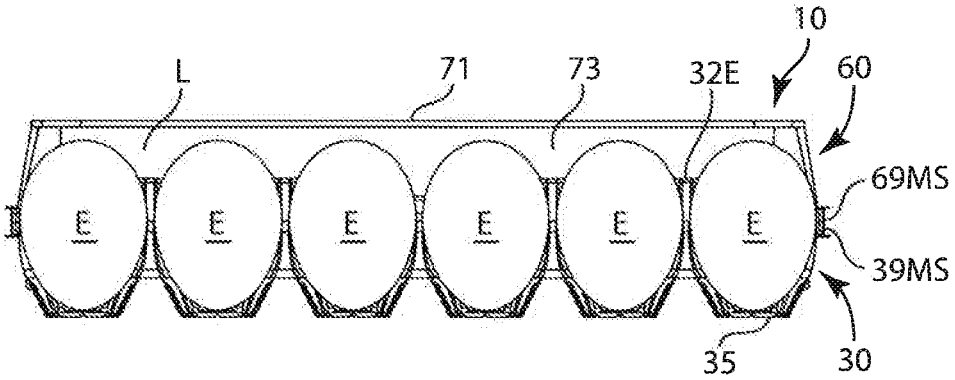

FIGS. 14-15 illustrate a base tray 30 filled with eggs in the cells 31 of the base tray, and a cross sectional view of the mating lid tray 60 fitted over the egg-containing base tray to form a closed (and filled) carton.

Base Tray (FIGS. 4-6)

FIGS. 4-6 show a plastic base tray 30 that provides a 5×6 rectilinear array of 30 base egg cells 31, each for holding a single egg E in a generally upright position (vertically aligned with the cell axis CA, as shown in FIG. 14). Each cell 31 is a cup shaped recess 33 formed by a sidewall 34 and bottom wall 35, the recess having an inner surface 33I that is sized and shaped to conform to the outer ovoid shape of a lower half of the egg that it gently supports in an upright position, shielding the egg from forces that impact the closed carton, as shown in FIGS. 12-13 and 15. Each cell bottom wall 35 has a flat annular portion 36 that lies in a horizontal bottom base plane BBP, allowing the base tray to sit flat on a store shelf (or on the exterior top wall of a lid of another closed carton on which it rests). The cells 31, 31 are joined by connecting walls 37 that extend between the cells and provide strength, stability and support, and the cells side walls 34 and bottom walls 35 themselves are reinforced by ribs or the like. The open top ends 38 of the cells all lie within a horizontal top base plane TBP defined by a top wall 39 of the base tray, the top wall having a generally rectilinear perimeter 39P, with a pair of opposing front and rear edges 39F and 39R, and a pair of opposing right and left side edges 39RS and 39LS (that extend between the front and rear edges respectively). The top base wall 39 includes, at the perimeter, one or more mating surfaces 39MS that align and mate with complementary mating surfaces 69MS on the lid tray, as described below. The base tray further includes cell posts 32, formed at the intersection of four cells, or along the perimeter at the intersection of two cells. The base cell posts are sized and shaped to mate with complementary lid posts 62 that extend downwardly from the lid, as described further below. There is a sub-group of elongated base cell posts 32E that are disposed beneath the open lid labelling area 70 (in the assembled carton); these are specially sized and shaped to engage the interior of the top wall 71 of the lid labeling area and support it from top compressive forces applied to the two top wall of the lid, so as to prevent such forces from either collapsing the closed carton or crushing the eggs in the open labeling area of the closed carton. In addition, there are base cell posts 32 aligned with the bottom of sidewall 72 of the lid labeling area, that engage and support the sidewall.

The base and lid trays 30, 60 each include a pair of mating handle components 45, 75, respectively, such that when the base and lid trays are assembled to form a closed carton (as shown in FIGS. 1-3) the mating handles provide both enhanced strength and ease of carrying of the assembled carton. The handles also facilitate handling of the base and lid trays separately during manufacture, packing and transport, and during and after filling the base tray with eggs. Each handle (of the lid and base trays) comprises a handle flange 46, 76 surrounding a handle recess 47, 77 respectively, the handle recesses of the base and lid trays forming mating recesses that are configured to nest, one within the other, and provide an indented area that base be easily grasped by hand for lifting or carrying the assembled base and lid trays of a closed carton. The surrounding handle flanges, here comprising an oval flange area 460 around the central oval handle recess 47 and two triangular flange areas 46T, 46T, each surrounding their own triangular recess 47T, disposed adjacent both ends of the oval flange area and extending toward the front and rear edges of the base or lid tray respectively. The handle flanges define an outermost handle perimeter 45P, 75P of the base or lid tray in a width W direction, while the front and rear base or lid tray edges 39F and 39R, 69F and 69R define an outermost tray perimeter 30P, 60P in a length L direction, transverse to the W direction, with the distances between the respective outermost perimeters in the W and L directions being substantially equal and defining a square base tray footprint. This provides the closed carton 10 with an outermost perimeter 10P sized to fit within and fill the square interior chamber of a packing case 90 for holding a 5×6 array of eggs (as further discussed below and shown in FIGS. 12-13), the square footprint (in horizontal cross section) of the base/lid/carton 30/60/10 being configured to fit within a packing case having a matching square interior cavity 91 (in horizontal cross section).

Lid Tray (FIG. 7-9)

FIGS. 7-9 show a plastic lid tray 60, sized and shaped to mate with the base tray 30, including a rectilinear array of lid cells 61 that matches the overall perimeter of the base cell array, but with fewer egg cells such that an open area 73 (free of egg cells) is provided in a 2×6 array portion of the lid to provide a labeling area in the top wall 71 of the lid tray. The interior open cavity 73 (surrounded by walls 71 and 72) allows a graphic printed label Las shown in FIGS. 14-15, to be inserted into the cavity, lying along the flat panel top wall 71 and visible there-through when the lid is formed of a transparent plastic material. Alternatively, a separate label can be attached to the exterior surface of top wall 71, and the top wall itself can be embossed or printed with labeling information. The lid labeling area 70 has a length 70L extending between the front and rear edges of the lid tray, and a width 70W extending the width of two columns of egg cells, such that there is a single column of 6 egg cells between the left side of the labeling area 70LS and the left side of the lid array, and two columns of 6 egg cells each (for a total of 12 egg cells) between the right side of the labeling area 10RS and the right side of the lid tray. Each of the lid cells comprises a recess 63 configured to cover a single egg disposed in a generally upright position in the cell 31 of the base tray that is vertically aligned with the lid cell 61 (vertically aligned with the cell axis CA, as shown in FIG. 14). Each cell is formed by a sidewall 64 and bottom wall 65 forming a cup shaped recess 63, having an inner surface 631 that is sized and shaped to conform to the outer ovoid shape of an upper half of the egg that it gently supports in an upright position, shielding the egg from forces that impact the closed carton, as shown in FIGS. 12-13 and 15. Each cell bottom wall 65 has a flat annular portion configured to lie in a horizontal lid base plane LBP when the lid sits on a flat supporting surface, and provides a flat surface on top of the lid of a closed carton when another closed carton rests on top of the lid. The cells 61, 61 are joined by connecting walls 67 that extend between the cells and provide strength, stability and support, and the cells themselves are reinforced by ribs or the like in the sidewalls and bottom walls. The open top ends of the cells all lie within a horizontal top lid plane TLP that defines a top wall 69 of the lid tray, the top wall having a generally rectilinear perimeter 69P, with a pair of opposing front and rear edges 69F and 69R, and a pair of opposing right and left side edges 69RS and 69LS (that extend between the front and rear edges respectively). The top lid wall includes, at the perimeter, one or more mating surfaces 69S that align and mate with complementary surfaces 39S on the base tray 30, as described above. The lid tray further includes cell posts 62, formed at the intersection of four cells, or along the perimeter at the intersection of two cells. The lid cell posts are sized and shaped to mate with complementary base posts 32 that extend upwardly from the base, as described above. There open lid labelling area has no lid posts and in the assembled carton is supported by the extended base posts 32E that support it from top compressive forces applied to the two top wall of the lid, so as to prevent such forces from either collapsing the closed carton or crushing the eggs in the open labeling area of the closed carton.

Lid and Base Trays in Open Position (FIGS. 10-11)

FIGS. 10-11 illustrate interior views of the base and lid trays 30, 60 respectively, in an open position, with the bottom wall 35 of the base tray 30 resting on a flat supporting surface and the top wall 65 of the lid tray 60 resting on another flat supporting surface. These views show a column of extended base tray cell posts 32E (5 full width posts, and two half width posts at the front and rear edges of the base tray 39F, 39R respectively, that will support the open lid labeling area 70, when the lid and base trays are in the closed position. This open view also shows the mating handle recesses 47, 77 in the lid and base trays; in this embodiment the interior surface of the base tray handle recess 47 provides a label area (here shown with the name of a source or provider embossed into the surface). A pair of mating triangular recesses 47T, 77T are provided in the base and lid trays, adjacent opposing sides of the central handle recess 470, 770, to provide additional support and strength to both the open tray and closed carton. The open area 73 in the lid tray is a generally rectilinear shaped recess with flat bottom wall 71 (to receive a labeling insert L as shown in FIGS. 12-13), visible through the lid top wall 71 when the tray is formed of transparent plastic, and a rectilinear sidewall 72 that surrounds the top wall for supporting the top wall.

Lid corner stabilizers 84 are provided in the bottom walls of the four lid cells to assist in retaining the lid and base trays in vertical alignment, and to withstand the application of transverse forces that would act to misalign the lid and base, and help prevent tipping when stacking a plurality of closed cartons for labeling, or placing on store shelves. The lid and/or base trays may further include de-nesting lugs, positioned in the corners of the tray, to assist in handling the empty trays (e.g., removing one lid from a stack of lids for insertion of a label in the open lid area). See the de-nesting lugs 86 in the corners of the lid tray 60 shown in FIG. 7. Another optional feature is to provide smooth cell bottoms on at least some of the lid and base cells to adhere to suction cups (e.g., to hold in position during de-nesting and/or labeling.

Stacked Trays, and Packing Container (FIGS. 12-13, 13A)

FIGS. 12-13 and 13A illustrate two arrangements of stacked trays. In FIG. 12, two closed cartons 10-A and 10-B are vertically stacked, with the bottom surfaces 35 of the base tray cells of the upper carton 10-B, resting on the top surfaces 65 of the lid cells and lid labeling area top wall 71 of the lower carton 10-A. In FIG. 13, four vertically stacked closed cartons 10-A, 10-B, 10-C and 10-D are disposed in an interior cavity 91 of a packing container 90, the interior cavity having a square horizontal cross section configures to receive/engage the outer perimeters 10P of the four stacked cartons, so as to hold them securely in the vertical stacked arrangement during shipment and handling in the case. The case 90 has carrying handles 92 on the various sidewalls of the case, near an open top end 93. FIG. 13A, shows a top view of the case 90 containing one or more vertically stacked cartons 10, enabling a user can reach into the case from the open top end 93 to remove one or more closed cartons by inserting their hands along opposing left and right sides of the cartons, more specifically in the open areas (gaps) between the interior sidewall surface of the case and the tapered left and right flange areas of the carton in order to reach under the dual handles of the closed cartons.

One advantage of the present embodiment is that a stack of closed cartons 10, each with a 5×6 array of egg cells, fits within an interior chamber of a standard packing case, having a square horizontal cross section of 12 inches×12 inches. In contrast, the prior art egg cartons with a 5×6 array of egg cells leaves a gap between the exterior edge of the carton (at its widest extent) and the interior sidewall of the case; this gap allows movement of the closed cartons in the stack which can damage the cartons and eggs during transit and handling. In contrast, the dual handles of the present embodiment eliminate the gaps between the widest extent of the carton in each of the L and W directions and the interior sidewall of the case, thereby eliminating detrimental transverse movement of the cartons in the stack and reducing or eliminating such damage to the cartons and eggs. The dual handles facilitate ready removal of the closed cartons from the interior chamber, supporting the carton(s) in a horizontal plane during insertion and removal form the cartons, again reducing damage to the cartons and eggs.

Filled Base Tray and Lid Tray in Open Position, and Closed Position (FIGS. 14-15)

FIGS. 14-15 illustrate a base 30 filled with eggs E in the cells 31 of the base tray, and a cross sectional view of the mating lid 60 fitted over the egg-containing base tray to form a closed (and filled) carton 10. The base holds 30 eggs in a 5×6 array, each egg E held securely in an upright vertical position (aligned with a central vertical cell axis of the aligned vase and lid cells) in an individual base cell. In FIG. 15 the lid tray 60 is shown over the filled base tray 60 in the closed position. The cross section of FIG. 15 is taken through the open labeling area 70, showing the open area 73 above the filled base cells and a separate paper label L positioned in the interior of the label area 73 adjacent the interior of the top wall 71.

Lid and Base Trays with Hinge Connection (FIGS. 16-19)

Figure 16:
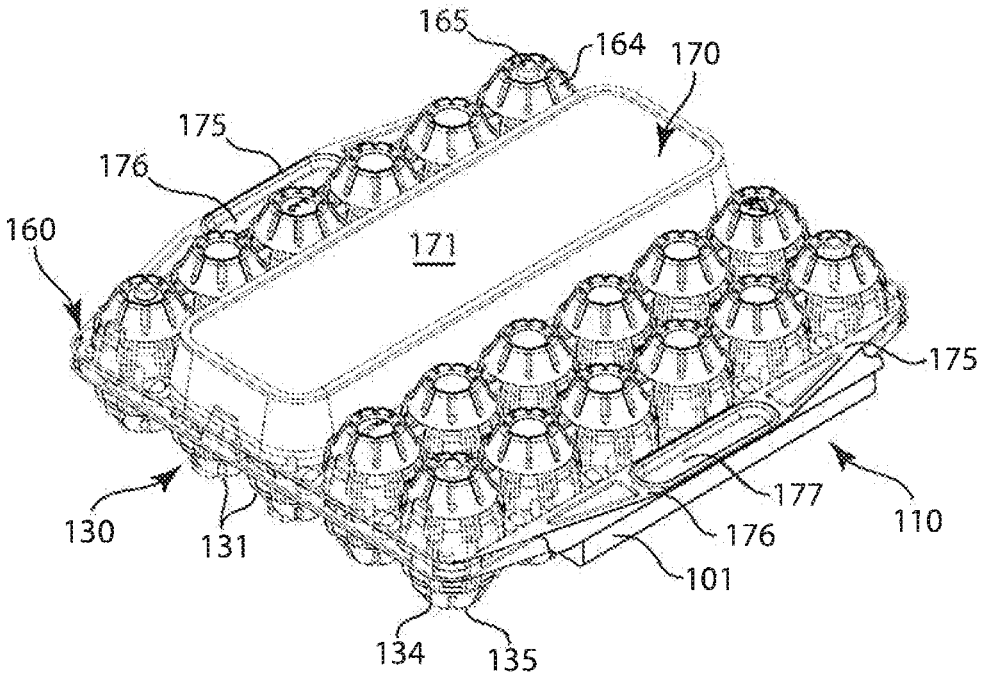
FIGS. 16-19 illustrate another embodiment in which the lid and base trays have a hinge connection.
Figure 17:
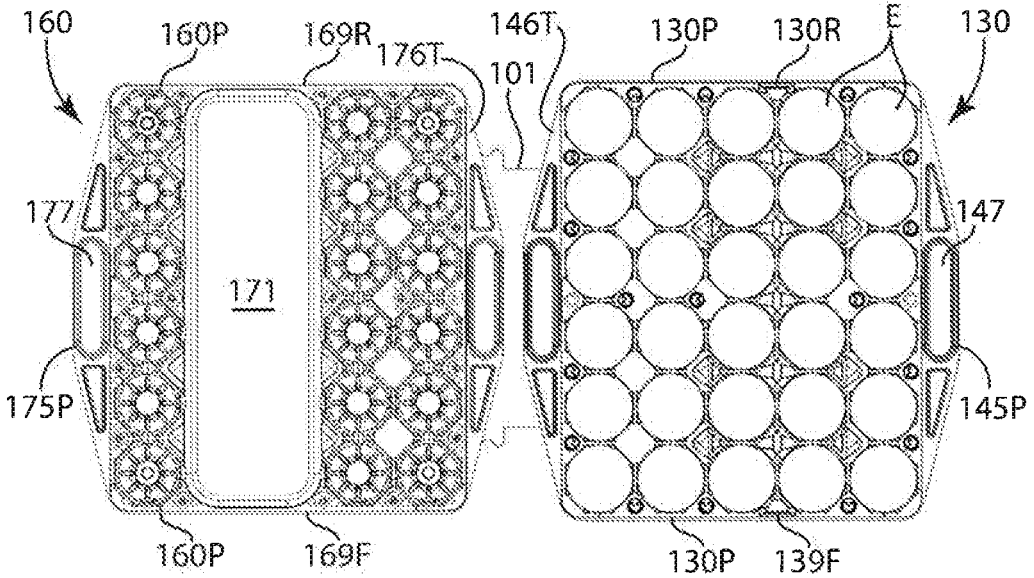
Figure 18:
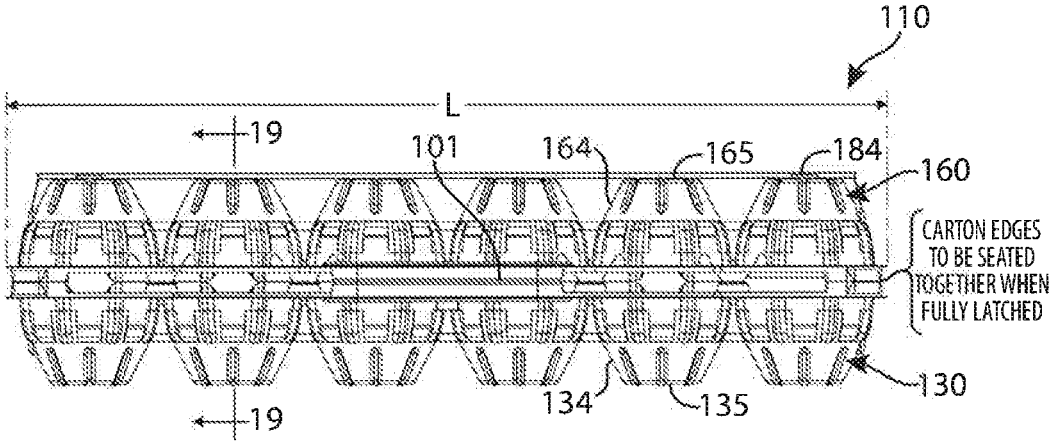
Figure 19:
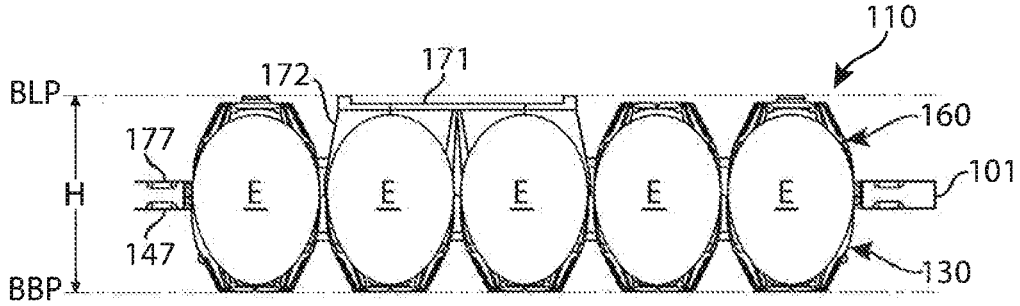

FIGS. 16-19 illustrate another embodiment in which the lid and base trays have a hinge connection; FIG. 16 is a top perspective view of the lid and base tray with hinge connection in a closed position showing the hinge connection between the aligned right side handle flanges of the lid and base trays; FIG. 17 is a top plan view of the open carton showing the hinge connection in the open position between the lid and base trays; FIG. 18 is right side view showing the hinge connection and the mating base tray and lid tray edges seated together in the close carton position; and FIG. 19 is a vertical cross sectional view of the closed carton showing a row of 5 eggs, each egg disposed in a vertical position between an aligned base cell and lid cell (in 3 of the columns) and disposed in a vertical position between a base cell and the lid panel area (in 2 of the 5 columns), with the hinge connection in the closed position on the right side of the carton.

In FIGS. 16-19, the various components of the base and lid trays are labeled with corresponding reference numbers in a "100 series" of number compared to those components in the first embodiment, with the integral carton of FIGS. 16-19 labeled 110 and the hinge connection labeled 101.

Materials and Manufacture

In one embodiment of the present invention, the base tray and lid tray are made of a solid thermoplastic material, such as a polyester, and more preferably a transparent thermoplastic material enabling a customer to view the eggs and/or labeling material inside of the closed carton. A suitable polyester is polyethylene terephthalate (PET), including both homopolymers and copolymers, virgin and recycled materials. Each of the lid and base trays can be molded from a solid sheet of polyester, for example by pressing the solid sheet between male and female dies to form the base cells (or lid cells and label area) and other structural and/or ornamental features of the base tray (or lid tray or integral base and lid trays with hinge connection), and then removing (trimming) any remaining portions of the sheet to from the base tray (or cell tray, or integral cell and base tray with hinge connection). Other suitable plastic materials for forming a solid lid and base trays include polyolefin (e.g., polyethylene (PE), polypropylene (PP)), and poly(lactic acid (PLA), including homopolymers, copolymers, mixtures and blends thereof, and including virgin and reclaimed (recycled) materials. In some embodiments, the plastic lid and/or base trays are opaque (not transparent).

According to one embodiment, each of the lid and base trays comprises a formed sheet of clear solid polyester having a thickness in a range of about 0.013 to about 0.022 inches.

According to one embodiment, each base cell has a vertical cell axis, aligned with the long axis of the egg and perpendicular to the base plane in which the bottom walls of the base cells reside, and an outwardly bowed sidewall portion sized to receive a major horizontal cell diameter (transverse to the long axis) of the egg.

According to one embodiment, the assembled carton holds 30 eggs in a 5×6 matrix of cell pockets (formed by the aligned base and lid cells, or the aligned base cells and lid panel area), the carton having an overall length of from about 11.6 to about 11.8 inches, a width of from about 11.6 to about 11.8 inches and a height of from about 2.6 to about 2.8 inches, at the respective outmost perimeter portions.

According to one embodiment, a plastic egg carton is provided having structural features that enable packaging of larger size eggs, e.g., large, extra-large, or jumbo eggs in a 5×6 array, in both oriented and non-oriented positions, while allowing for easy filling, closing, handling and packing into shipping containers. As used herein, large eggs fall in a weight range of about 54-61 grams per egg, extra-large eggs fall in a range of about 61-68 grams per egg, and jumbo eggs fall in a range of about 68-77 grams per egg. The carton may be configured to hold a variety of smaller sized eggs, namely small (about 40-47 grams) or medium eggs (about 47-54 grams), and alternative super jumbo eggs (greater than about 77 grams). Preferably, the carton can be used with standard egg grade equipment and the carton will fit into standard cases (containers, such as corrugated paper, wire or plastic cases) designed for holding a plurality of egg cartons.

In accordance with one embodiment of the invention, the assembled base and lid trays form a plurality (e.g., a 5×6 array) of individual egg cell pockets that can accept the larger, heavier and more fragile extra-large eggs in both oriented (large diameter down toward the bottom of the base cell) and non-oriented (larger diameter up toward the top of the base cell) positions, versus prior art containers that require a correct (oriented, larger diameter down) positioning in the cells. The base and lid trays include a larger cell construction able to hold an extra-large egg that is non-oriented, i.e., enabling the largest diameter of the egg to fit into the base cell). By accommodating both oriented and non-oriented eggs, this allows more efficient processing, carton handling and placement into master containers (packing cases).

An apparatus and method for making solid plastic trays are known, for example including a female mold cavity and a plug assist for pressure forming a base tray or lid tray with a turned up lip edge, in the mold. A continuous sheet of plastic is fed to the mold and is formed by the plug assist pushing the sheet toward the female cavity in combination with the application of a vacuum on the exterior side of the sheet/carton to draw the sheet into the recesses of the mold cavity. The formed carton is then trimmed at a separate trim station, where the tray is positioned between the female die cavity and a cutting edge punch having a knife edge, the cavity and punch being brought together to sever (cut) the lip edges from the sheet to form the terminal ends of the lip edges, in a direction aligned with the vertical height H direction of the carton. Other forming and trimming methods known to those skilled in the art can be used for forming the carton and turned up lip edge of a base or lid tray according to the present invention.

The invention claimed is:

1. A closed egg carton (10) for packaging eggs comprising assembled mating base and lid trays (30, 60) with dual mating handle flanges (46,76), the base tray (30) comprising:

a) a thermoformed solid sheet of plastic comprising a top base wall and a rectilinear array of recessed base cells arranged in rows and columns depending from the top base wall, each base cell having an open top end, a sidewall and a closed bottom wall and being sized and shaped to hold one egg in a generally upright position with the long axis of the egg disposed in a vertical direction transverse to a base plane in which the bottom walls of the base cells reside;

b) the top base wall having an outer rectilinear base wall perimeter (39) surrounding the array of base cells having opposing front and rear base wall perimeter edges and opposing left and right side base wall perimeter edges;

the lid tray (60) comprising:

c) a thermoformed solid sheet of plastic comprising a top lid wall and a plurality of lid cells depending from the top lid wall and arranged in a rectilinear array of rows and columns, each lid cell being aligned with one base cell and configured to cover an egg disposed in the aligned base cell;

d) the top lid wall having an outer rectilinear lid wall perimeter (69) surrounding the array of lid cells having opposing front and rear lid wall perimeter edges and opposing left and right side lid wall perimeter edges;

the dual mating handle flanges (46, 76) comprising two opposing pairs of base and lid handle flanges extending from each of two of the opposing perimeter edges of each of the base wall and lid wall perimeters and including:

e) mating handle recesses (47, 77) configured to nest one within the other, and f) tapered handle flange areas (46T, 76T) on opposing sides of the mating handle recesses to provide an indented area that can be easily grasped by hand for lifting or carrying the assembled base and lid trays of the closed carton (10).

2. The closed egg carton (10) of claim 1, wherein:

the dual handle flanges (46, 76) of the base tray each define an outermost handle perimeter of the base tray in a width W direction, and the front and rear base tray edges define an outermost tray perimeter in a length L direction, transverse to the W direction, the distances between the respective outermost perimeters in the W and L directions being substantially equal and defining a square base tray footprint; and the dual handle flanges (46, 76) of the lid tray each define an outermost lid handle perimeter of the lid tray in a width W direction, and the front and rear lid tray edges define an outermost lid tray perimeter in a length L direction, transverse to the W direction, the distances between the respective outermost lid perimeters in the W and L directions being substantially equal and defining a square lid tray footprint.

3. The closed egg carton (10) of claim 2, wherein:

the square base tray and lid tray footprints are configured to fit within a shipping carton having a matching square interior cavity.

4. The closed egg carton (10) of claim 1, wherein:

the rectilinear base array and the rectilinear lid tray each comprise an aligned 5 by 6 array of cells.

5. The closed egg carton (10) of claim 2, wherein:

the rectilinear base array comprises a 5 by 6 array of cells;

each base handle flange and lid handle flange includes a supporting flange area surrounding the handle recess, and the flange area has a reduced width from the square base tray footprint so as to define an open area within the square base tray footprint.

6. The closed egg carton (10) of claim 1, wherein:

the base and lid trays have mating support posts disposed between the cells of the base and lid arrays for maintaining alignment of the mating base and lid cells.

7. The closed egg carton (10) of claim 1, wherein:

the lid tray includes a flat top wall label panel area without lid cells.

8. The closed egg carton (10) of claim 7, wherein:

the label panel area is disposed between rows of lid cells and between the front and rear lid edges.

9. The closed egg carton (10) y of claim 7, wherein:

the base tray includes support posts for supporting the label panel area.

10. A stack of closed egg cartons (10) according to claim 1, comprising a plurality of assembled mating base and lid trays aligned in a stack, with the aligned cells of the lid and base arrays aligned with a vertical stack axis.

11. A stack of closed egg cartons (10) according to claim 2, comprising a plurality of assembled mating base and lid trays aligned in a stack, with the aligned cells of the lid and base arrays aligned with a vertical stack axis.

12. A carton containing the stack of closed egg cartons (10) according to claim 11, wherein:

the square base tray and lid tray footprints are configured to engage with an interior cavity of the carton.

13. The stack of claim 10, wherein:

the rectilinear base array comprises a 5 by 6 array of base cells.

14. The stack of claim 10, wherein:

the rectilinear base array and the rectilinear lid array each comprise an aligned 5 by 6 array of base and lid cells.

15. The stack of claim 10, wherein:

the rectilinear base array comprises a 5 by 6 array of base cells and the lid array comprises a 3 by 6 array of lid cells and a label panel area without lid cells.

16. The closed egg carton (10) of claim 1, wherein:

the base tray and lid tray are thermoformed from the same solid sheet of plastic and include a hinge connecting portion between the base tray and lid tray.

17. The closed egg carton (10) of claim 16, wherein:

the hinge portion extends between the base and lid handle flanges on the left of right sides of the aligned base and lid trays.

18. The closed egg carton (10) of claim 1, wherein the assembled mating base and lid trays have mating surfaces (39MS, 69MS) on the perimeters (30P, 60P) of the base and lid trays.

19. A closed egg carton (10) packed in a shipping container (90), the closed egg carton (10) comprising assembled mating base and lid trays (30, 60) with dual mating handle flanges (46, 76), the base tray (30) comprising:

a) a thermoformed solid sheet of plastic comprising a top base wall and a rectilinear array of recessed base cells arranged in rows and columns depending from the top base wall, each base cell having an open top end, a sidewall and a closed bottom wall and being sized and shaped to hold one egg in a generally upright position with the long axis of the egg disposed in a vertical direction transverse to a base plane in which the bottom walls of the base cells reside;

b) the top base wall having an outer rectilinear base wall perimeter (39) surrounding the array of base cells having opposing front and rear base wall perimeter edges and opposing left and right side base wall perimeter edges;

the lid tray (60) comprising:

c) a thermoformed solid sheet of plastic comprising a top lid wall and a plurality of lid cells depending from the top lid wall and arranged in a rectilinear array of rows and columns, each lid cell being aligned with one base cell and configured to cover an egg disposed in the aligned base cell;

d) the top lid wall having an outer rectilinear lid wall perimeter (69) surrounding the array of lid cells having opposing front and rear lid wall perimeter edges and opposing left and right side lid wall perimeter edges;

the dual mating handle flanges (46, 76) comprising two opposing pairs of base and lid handle flanges extending from each of two of the opposing perimeter edges of each of the base wall and lid wall perimeters and including:

e) mating handle recesses (47, 77) configured to nest one within the other, and f) tapered handle flange areas (46T, 76T) on opposing sides of the mating handle recesses to provide an indented area that can be easily grasped by hand for lifting or carrying the assembled base and lid trays of the closed carton (10).

* * * * *